US010541477B2

(12) United States Patent
Powell

(10) Patent No.: US 10,541,477 B2
(45) Date of Patent: Jan. 21, 2020

(54) COMBINED OMNIDIRECTIONAL AND DIRECTIONAL ANTENNAS

(71) Applicant: Radio Frequency Systems, Inc, Meriden, CT (US)

(72) Inventor: Charles M Powell, Vernon, CT (US)

(73) Assignee: Nokia Shanghai Bell Co., Ltd., Shanghai (CN)

( * ) Notice: Subject to any disclaimer, the term of this patent is extended or adjusted under 35 U.S.C. 154(b) by 239 days.

(21) Appl. No.: 15/393,884

(22) Filed: Dec. 29, 2016

(65) Prior Publication Data

US 2018/0026380 A1 Jan. 25, 2018

Related U.S. Application Data

(60) Provisional application No. 62/366,293, filed on Jul. 25, 2016.

(51) Int. Cl.
*H01Q 21/24* (2006.01)
*H01Q 21/08* (2006.01)
(Continued)

(52) U.S. Cl.
CPC ..... *H01Q 21/24* (2013.01); *H01Q 1/2291* (2013.01); *H01Q 1/48* (2013.01); *H01Q 5/50* (2015.01);
(Continued)

(58) Field of Classification Search
CPC .... H01Q 21/24; H01Q 21/293; H01Q 25/002; H01Q 21/08; H01Q 21/205; H01Q 1/2291; H01Q 5/50; H01Q 9/065; H01Q 1/48
See application file for complete search history.

(56) References Cited

U.S. PATENT DOCUMENTS 2,413,745 A * 1/1947 Carter ..... H01Q 21/205 343/742
6,337,628 B2 1/2002 Campana, Jr.
(Continued)

FOREIGN PATENT DOCUMENTS

WO 2002041449 A2 5/2002

OTHER PUBLICATIONS

D. Patron, D. Piazza and K.R. Dandekar; "Wideband Planar Antenna With Reconfigurable Omnidirectional and Directional Radiation Patterns"; Electronics Letters, Apr. 11, 2013, p. 516-518, vol. 49, Issue 8. Publisher: IET, USA, DOI:10.1049/el.2013.0234.
(Continued)

*Primary Examiner* — Hoang V Nguyen
*Assistant Examiner* — Awat M Salih
(74) *Attorney, Agent, or Firm* — Harrington & Smith

(57) ABSTRACT

An apparatus, e.g. a hybrid antenna, includes a plurality of antenna arrays. Each array includes antenna elements, and each array is located on a polygonal antenna body such that each array faces a different direction. An RF network includes first and second duplexers and a divider. The first duplexer is configured to split a received multifrequency drive signal into a first component having a first frequency and a second component having a second frequency. The divider is configured to split the first component into attenuated portions, and to direct one of the attenuated portions to a first of the plurality of antenna arrays. The second duplexer is configured to combine another of the attenuated portions with the second drive signal component to form a combined drive signal component, and to direct the combined drive signal component to a second of the antenna arrays.

20 Claims, 4 Drawing Sheets

(51) Int. Cl.

| | |
|---|---|
| ***H01Q 21/20*** | (2006.01) |
| ***H01Q 21/29*** | (2006.01) |
| ***H01Q 25/00*** | (2006.01) |
| ***H01Q 5/50*** | (2015.01) |
| ***H01Q 1/22*** | (2006.01) |
| ***H01Q 1/48*** | (2006.01) |
| ***H01Q 9/06*** | (2006.01) |

(52) U.S. Cl.
CPC ..... *H01Q 9/065* (2013.01); *H01Q 21/08* (2013.01); *H01Q 21/205* (2013.01); *H01Q 21/293* (2013.01); *H01Q 25/002* (2013.01)

(56) References Cited

U.S. PATENT DOCUMENTS

| | | | | |
|---|---|---|---|---|
| 6,448,930 | B1 * | 9/2002 | Judd | H01Q 1/007 343/700 MS |
| 8,884,819 | B2 | 11/2014 | Wu | |
| 9,019,165 | B2 | 4/2015 | Shtrom et al. | |
| 2002/0113743 | A1 * | 8/2002 | Judd | H01Q 1/007 343/757 |
| 2007/0205955 | A1 * | 9/2007 | Korisch | H01Q 1/246 343/853 |
| 2009/0027300 | A1 * | 1/2009 | Kudo | H05K 9/0003 343/912 |
| 2011/0159877 | A1 * | 6/2011 | Kenington | H01Q 1/246 455/445 |
| 2015/0084829 | A1 | 3/2015 | Jenwatanavet et al. | |
| 2015/0349418 | A1 | 12/2015 | Patron et al. | |
| 2017/0195018 | A1 * | 7/2017 | Ma | H01Q 21/0006 |

OTHER PUBLICATIONS

Ahmed, Elsayed, et al. "Full-Duplex Systems Using Multireconfigurable Antennas" IEEE Transactions on Wireless Communications, Jun. 16, 2015, p. 5971-5983, vol. 14, Issue 11. Publisher: IEEE, USA, DOI: 10.1109/TWC.2015.2445776.

Maloratsky, Leo G. "Switched Directional/Omnidirectional Antenna Module for Amplitude Monopulse Systems" IEEE Antennas and Propagation Magazine, Oct. 2009, vol. 51, Issue 5. Publisher: IEEE, USA, DOI: 10.1109/MAP.2009.5432048.

Zhou, Zhengjuan, and Xing Zhang. "Directional Antenna-Based Single Channel Full Duplex" IET Communications, Nov. 5, 2015, p. 1999-2006, vol. 9, Issue 16. Publisher: IET, USA, DOI: 10.1049/iet-com.2014.1153.

* cited by examiner

COMBINED OMNIDIRECTIONAL AND DIRECTIONAL ANTENNAS

TECHNICAL FIELD

The present invention relates generally to the field of wireless communications, and, more particularly, but not exclusively, to methods and apparatus useful for transmitting and receiving radio-frequency signals.

BACKGROUND

This section introduces aspects that may be helpful to facilitate a better understanding of the inventions. Accordingly, the statements of this section are to be read in this light and are not to be understood as admissions about what is in the prior art or what is not in the prior art. Any techniques or schemes described herein as existing or possible are presented as background for the present invention, but no admission is made thereby that these techniques and schemes were heretofore commercialized, or known to others besides the inventors.

An antenna is typically directional or omni-directional. A directional antenna directs radio frequency (RF) signal power in a specific direction, while an omni-directional antenna distributes the power approximately equally in all directions. The structure of a directional antenna is typically very different from that of an omni-directional antenna. A directional antenna typically radiating elements mounted to a groundplane, focusing RF power in a single direction. An omni-directional antenna typically either has no groundplane, so the RF radiates about equally in all directions, or has multiple sets of radiating elements and groundplanes that each radiate equally to provide 360 degrees of coverage. Some antennas combine directional and omni-directional antennas in a single assembly, vertically stacking the antennas, e.g. with the omni-directional antenna on the bottom of the overall structure and the directional antenna stacked on top, or vice versa. Such structures may be physically too large for various reasons to be suitable.

SUMMARY

The inventors disclose various apparatus and methods that may be beneficially applied to, e.g., radio frequency transmission and/or reception. While such embodiments may be expected to provide improvements in performance and/or reduction of cost or size relative to existing antennas, no particular result is a requirement of the present invention unless explicitly recited in a particular claim.

One embodiment provides an apparatus, e.g. a hybrid antenna, including a plurality of antenna arrays. Each array includes antenna elements, and each array is located on a polygonal antenna body such that each array faces a different direction. An RF network includes first and second duplexers and a divider. The first duplexer is configured to split a received multifrequency drive signal into a first component having a first frequency and a second component having a second frequency. The divider is configured to split the first component into attenuated portions, and to direct one of the attenuated portions to a first of the plurality of antenna arrays. The second duplexer is configured to combine another of the attenuated portions with the second drive signal component to form a combined drive signal component, and to direct the combined drive signal component to a second of the antenna arrays.

In some embodiments the polygonal antenna body has a triangular cross-section, and the plurality of antenna arrays includes three antenna arrays. Each array has a neighboring antenna array on each of two neighboring sides of the antenna body, and each of the antenna arrays is arranged to direct radio-frequency energy at an angle of about 120° with respect to each of its neighboring antenna arrays. In some embodiments the antenna arrays are arranged around an axis that is oriented vertically with respect to the ground. In some embodiments each of the antenna elements comprises a dipole antenna. In some embodiments the network is configured to operate bidirectionally.

Another embodiment provides an apparatus, e.g. a hybrid antenna, including first and second duplexers and a power divider. Each of the duplexers has a common port, a high-pass filter port and a low-pass filter port. The power divider includes a common port and a plurality of attenuated ports. A first filter port type of the first duplexer is connected to a same filter port type of the second duplexer. A second filter port type of the first duplexer is connected to a common port of the power divider. A same second filter port type of the second duplexer is connected to a first attenuated port of the power divider.

Some embodiments also include a first antenna array connected to a common port of the second duplexer, and a second antenna array connected to a second attenuated port of the divider. In some such embodiments each of the antenna elements comprises a dipole antenna. Some embodiments further include a first antenna array connected to a common port of the second duplexer, a second antenna array connected to a second attenuated port of the power divider, and a third antenna array connected to a third attenuated port of the power divider, wherein the first, second and third antenna arrays are each located on a different side of a polygonal antenna body such that each array faces a different direction. In some embodiments the polygonal antenna body has a triangular cross-section, and the plurality of antenna arrays consists of three antenna arrays, each having a neighboring antenna array on each of two neighboring faces, and each of the antenna arrays being arranged to direct radio-frequency energy at an angle of about 120° with respect to each of its neighboring antenna arrays.

Other embodiments include methods, e.g. of manufacturing an apparatus, configured as described for any of the preceding embodiments.

BRIEF DESCRIPTION OF THE DRAWINGS

A more complete understanding of the present invention may be obtained by reference to the following detailed description when taken in conjunction with the accompanying drawings wherein.

DETAILED DESCRIPTION

Figure 1B:
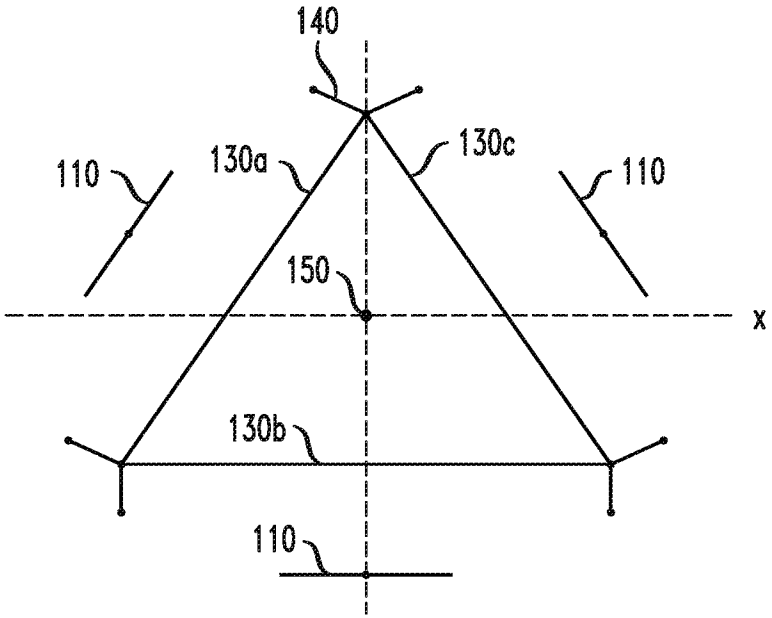
FIG. 1B PRIOR ART
FIG. 1A and 1B respectively illustrate a perspective view and an axial view of a conventional omni-directional antenna having three faces oriented 120° from each other.

Various embodiments are now described with reference to the drawings, wherein like reference numerals are used to refer to like elements throughout. While such embodiments may be expected to provide improvements in performance and/or reduction of cost of relative to conventional approaches, no particular result is a requirement of the present invention unless explicitly recited in a particular claim. In the following description, for purposes of explanation, numerous specific details are set forth in order to provide a thorough understanding of one or more embodiments. It may be evident, however, that such embodiment(s) may be practiced without these specific details. In other instances, well-known structures and devices are shown in block diagram form in order to facilitate describing one or more embodiments.

There exists a need for an antenna design that distributes the power of the antenna directionally for some frequencies and omni-directionally for other frequencies. One known solution is to vertically stack the antennas. The omni directional antenna may be combined with a directional antenna stacked on top or vice a versa. This solution is unsuitable in some applications, e.g. because a size constraint for aesthetic reasons may undesirably constrain the placement of the antennas, detrimentally affecting performance of the combined antenna.

Embodiments disclosed herein address one or more deficiencies of conventional implementation, e.g. by providing a more size-efficient technique of using an omni antenna with multiple sets of radiating elements and groundplanes, but use internal duplexers so that the frequency for which directional patterns are desired only goes to one set of radiating elements, while the frequencies for which omni-directional coverage is required continue to go to all of the multiple sets of radiating elements.

Figure 1A:
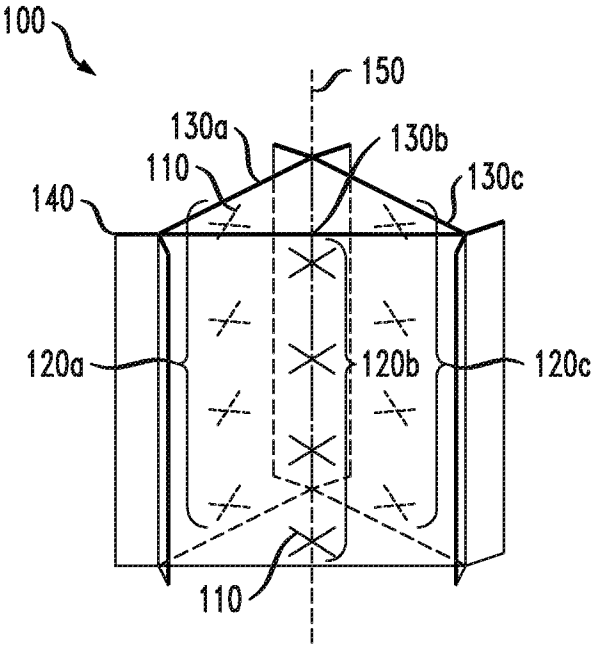
FIG. 1A PRIOR ART

FIGS. 1A and 1B illustrate aspects of a conventional omni-directional antenna 100 to guide the reader in the following discussion of various embodiments. FIG. 1A illustrates a perspective view of the antenna 100, while FIG. 1B illustrates a top-down plan view of the antenna 100 of FIG. 1A. Referring concurrently to FIGS. 1A and 1B, the antenna 100 includes a plurality of antenna elements 110. The antenna elements 110 may be, e.g. dope antennas. The antenna elements 110, which may radiate or receive RF signals, are arranged in linear arrays, e.g. three arrays 120*a*, 120*b*, 120*c*, that each include four antenna elements 110 in the illustrated example. Ground planes 130*a*, 130*b* and 130*c* may be nominally rectangular, with additional ground reference provided by grounded wings 140. The arrays 120*a*/120*b*/120*c* and ground planes 130*a*/130*b*/130*c* are nominally arranged symmetrically around an axis of rotation 150.

Figure 2B:
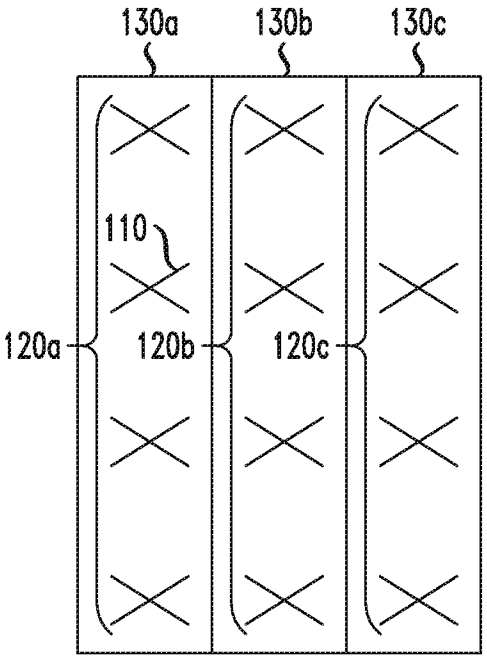
FIG. 2B PRIOR ART
FIG. 2A and 2B illustrate a stylized view of the conventional antenna of FIGS. 1A and 1B, wherein the antenna is "unfolded" to provide a view of all faces of the antenna in the plane of the drawing.
Figure 2A:
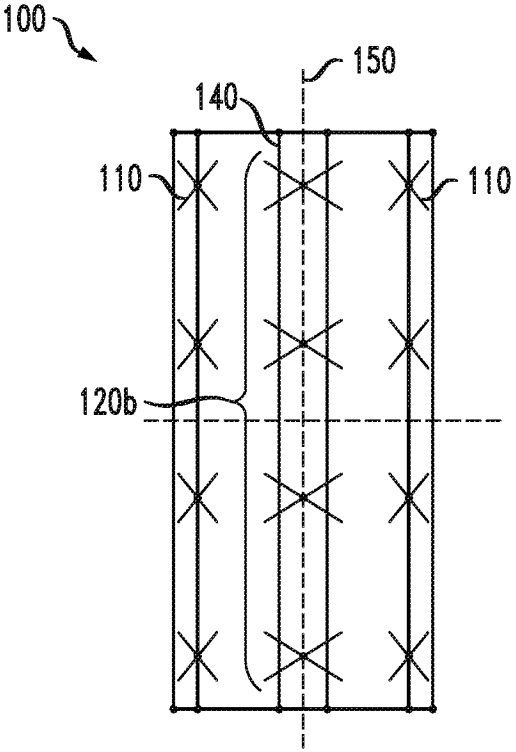
FIG. 2A PRIOR ART

FIG. 2A illustrates a side view of the antenna 100 as facing the dipole array 120*b*. For convenience of visualization, the triangular arrangement of the antenna 100 may be projected, or "unfolded" onto a rectangular plane as illustrated in FIG. 2B, wherein the ground planes 130*a*, 130*b*, 130*c* are shown as lying in the plane only for the purpose of illustration. In other words, the arrangement shown in FIG. 2B is schematic and does not correspond to a physical arrangement of the antennas arrays 120*a*/120*b*/120*c* and the ground planes 130*a*/130*b*/130*c*.

Figure 3:
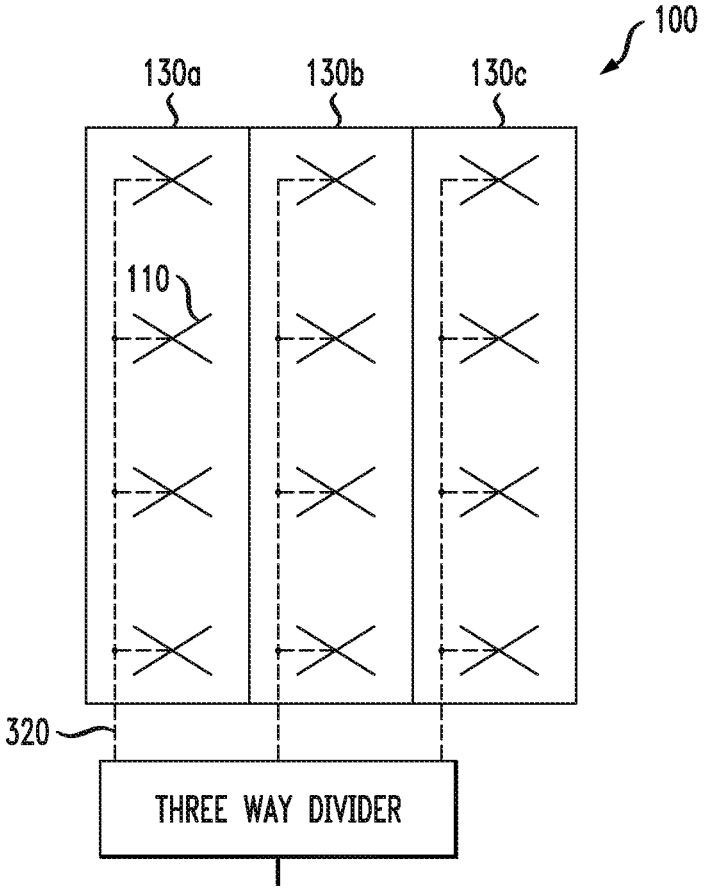
FIG. 3 PRIOR ART
FIG. 3 illustrates the conventional antenna of FIGS. 1A and 1B, in which a power divider distributes a transmitted RF signal about equally among the three faces.

FIG. 3 illustrates a conventional scheme of delivering power to the antenna elements 110. In this scheme, RF power driving the antenna 100 typically enters a connector at the bottom of the antenna 100 and is the split via an unreferenced three-way power divider such that each of the three arrays 130*a*/130*b*/130*c* receive a same amount of power. An omni-directional pattern may thereby be formed with three beam peaks of equal intensity. Of course this method of delivering power may be applied to other conventional antennas with more than three antenna arrays. Notably, this conventional scheme does not provide an ability to use the antenna 100 in a directional manner.

Figure 4:
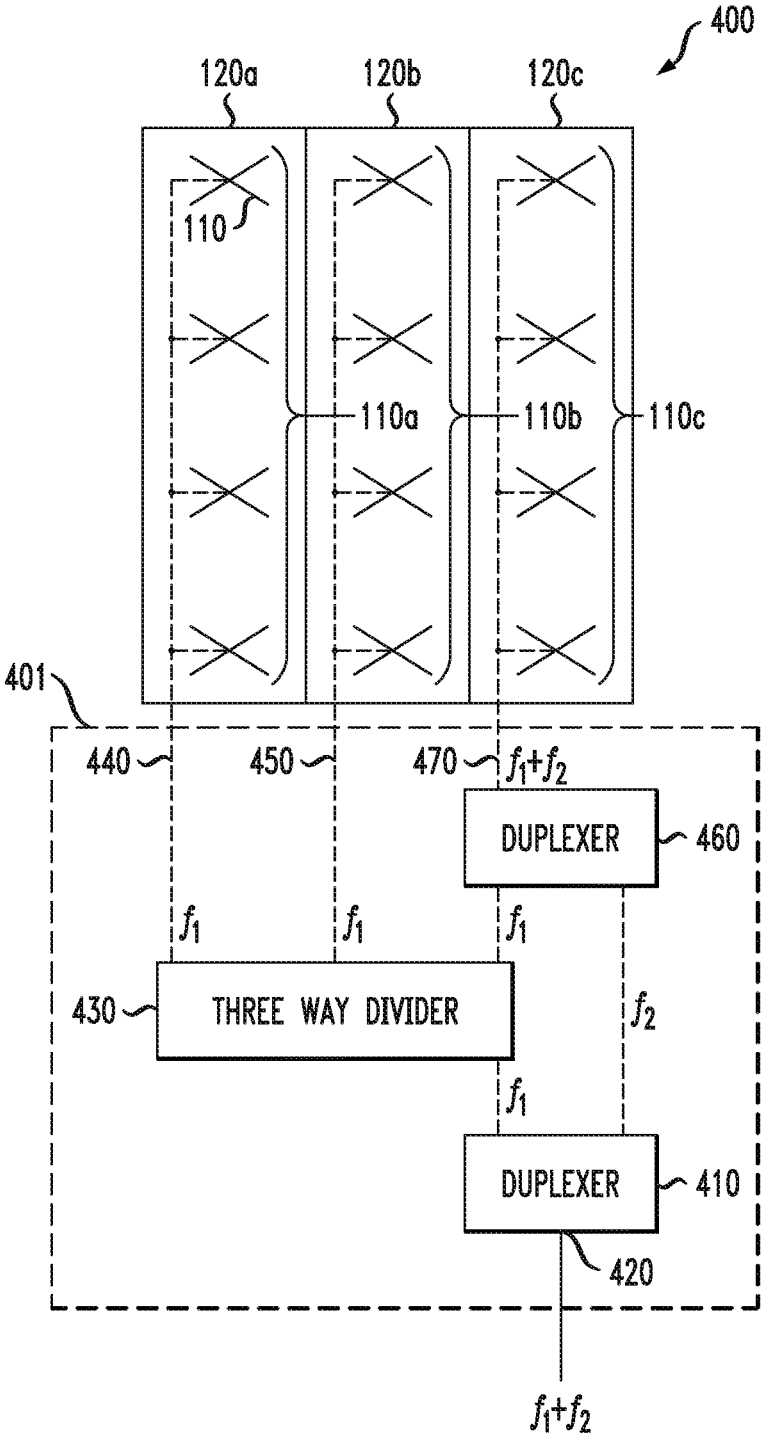
FIG. 4 illustrates, in a stylized fashion, three faces of a hybrid antenna according to one or more embodiments, in which two duplexers cooperate with a power divider to selectively distribute two RF signal frequencies among three faces to provide omni-directional transmission of one frequency and unidirectional transmission of the other frequency.

FIG. 4 illustrates an apparatus, e.g. an antenna 400, according to an embodiment of the disclosure. The antenna 400 is illustrated schematically similar to FIG. 2B to show to connections to several antenna arrays. The schematic presentation may correspond to an antenna structure similar to the conventional antenna 100, but is not limited to such a conventional arrangement. Moreover, where such an antenna has an axis of rotation similar to the axis 150 (FIG. 1), such an axis may be perpendicular to a ground surface, but is not limited to such a configuration. Unlike the conventional antenna 100, the antenna 400 may provide omni-direction operation for some frequencies, and unidirectional operation for other frequencies. Thus a separate directional antenna array is not needed, and space may be saved in an antenna installation, e.g. a cellular tower. The illustrated embodiment presents without limitation a configuration suitable for operating omnidirectionally with respect to a first frequency $f_1$ and uni-directionally a second frequency $f_2$. The antenna 400 may be considered and referred to as "hybrid" antenna to reflect its ability to transmit and or receive signals in an omnidirectional and/or unidirectional manner.

Before describing the operation of the antenna 400, some nomenclature is set forth to assist interpretation of the described embodiment and the claims.

A duplexer is a device that may be used to separate an RF signal carrying two frequency components, e.g. $f_1$ and $f_2$, received at a common port, and output each frequency at one of two filter ports. The term "filter port" refers to the operation of the duplexer to exclude one of the two received frequencies from each filter port output, but this term does not imply any particular internal configuration of the duplexer, and is not to be construed to limit the duplexer to any particular internal configuration. As used herein, the duplexer has two type of filter ports, a high-pass filter port to which a higher-frequency component of an input signal may be directed, and a low-pass filter port to which a higher-frequency component of an input signal may be directed. In the following discussion either type of port may be referred to as a "first type" or a "second type". Where a filter port of a first duplexer is described or claimed to be coupled to a same port type of a second duplexer, either the high-pass filter ports of the two duplexers are directly coupled (e.g. no intervening RF components other than an RF cable), or the low-pass filter ports are directly coupled. Unless stated otherwise, any duplexer described or claimed may operate bidirectionally, e.g. to separate two frequency components received at the common port, or to combine two frequencies received at the filter ports into a single signal.

A power divider, or simply "divider", is a device that may split an RF signal received at a common port among two or more "attenuated ports" without regard to frequency. Unless otherwise stated, the division is about equal among the attenuation ports; thus a divider having N attenuation ports may split a signal having unity power into N signals having a power of 1/N. Unless stated otherwise, any divider described or claimed may operate bidirectionally, e.g. to split a signal received at the common port among the attenuation ports, or to combine signals received at the attenuation ports.

Referring now to FIG. 4, the operation of the antenna 400 is described for the case that a signal is transmitted by the antenna 400. It will be immediately apparent to those skilled in the pertinent art that the operation may be reversed for the case of a signal received by the antenna 400. Furthermore, the embodiment is described without limitation for the case of a signal including two frequency components, $f_1$ and $f_2$, either of which may be the higher frequency.

An RF network 401 receives an RF signal that includes $f_1$ and $f_2$ signal components. A first duplexer 410 receives the RF signal at a common port 420, and provides separated $f_1$ and $f_2$ signal components at corresponding unreferenced filter ports. A three-way divider 430 receives the $f_1$ signal component from the duplexer 410, and divides the $f_1$ signal into three portions such that about one third of the signal appears at each of three unreferenced attenuated ports. First and second attenuated ports provide signals 440 and 450 respectively to the antenna array 110*a* and the antenna array 110*b* to be transmitted.

A second duplexer 460 receives the $f_2$ signal component of the received RF signal from the same filter port type of the duplexer 410, and a portion of the $f_1$ signal from the third attenuated port of the divider 430, combines the $f_1$ and $f_2$ signals components, and directs the combined $f_1$ and $f_2$ signal 470 to the antenna array 110*c*. Thus, while the antenna arrays 110*a* and 110*b* only receive the $f_1$ signal, the antenna array 110*c* may receive both the $f_1$ and $f_2$ signals. This configuration provides the antenna 400 the capability of transmitting an omni-directional pattern for $f_1$, and a uni-directional pattern for $f_2$.

It is noted that either of $f_1$ and $f_2$ may be present or absent. Moreover, as previously noted, the network 401 may operate bidirectionally to receive a signal with frequency $f_1$ from the antenna arrays 110*a*, 110*b*, 110*c* and/or a signal with frequency $f_2$ from the antenna array 110*c*, combine the $f_1$ and $f_2$ (if both are present), and provide the received signal component(s) at the common port of the duplexer 410 for further processing. Moreover, the described principle may be applied to as few as two antenna arrays, or to more than three antenna arrays. The described principle may also be applied to an antenna configuration in which all of N antenna arrays are configured to transmit and/or receive at a first frequency, e.g. $f_1$, and any number fewer than N of the antenna arrays are configured to transmit and/or receive at a second frequency, e.g. $f_2$.

Unless explicitly stated otherwise, each numerical value and range should be interpreted as being approximate as if the word "about" or "approximately" preceded the value of the value or range.

It will be further understood that various changes in the details, materials, and arrangements of the parts which have been described and illustrated in order to explain the nature of this invention may be made by those skilled in the art without departing from the scope of the invention as expressed in the following claims.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

Also for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements.

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they formally fall within the scope of the claims.

The description and drawings merely illustrate the principles of the invention. It will thus be appreciated that those of ordinary skill in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

Although multiple embodiments of the present invention have been illustrated in the accompanying Drawings and described in the foregoing Detailed Description, it should be understood that the present invention is not limited to the disclosed embodiments, but is capable of numerous rearrangements, modifications and substitutions without departing from the invention as set forth and defined by the following claims.

The invention claimed is:

1. An apparatus, comprising:

a plurality of antenna arrays, each array of said plurality of antenna arrays comprising one or more antenna elements, each array of said plurality of antenna arrays being located on a separate side of a polygonal antenna body having three or more sides such that each array faces in a different direction; and a radio-frequency (RF) network comprising:

a first duplexer for splitting a received multifrequency drive signal having two frequency components into a first component having a first frequency and a second component having a second frequency;

a divider for splitting said first component into three or more attenuated portions, and for directing one of said three or more attenuated portions to a first array of said plurality of antenna arrays; and a second duplexer for combining another of said three or more attenuated portions with said second component to form a combined drive signal component, and for directing said combined drive signal component to a second array of said plurality of antenna arrays.

2. The apparatus of claim 1, wherein each of said plurality of antenna arrays is located at one of three faces of said polygonal antenna body, each array having a neighboring antenna array on each of two neighboring faces, and each of said antenna arrays being arranged to direct radio-frequency energy at an angle of about 120° with respect to each of its neighboring antenna arrays.

3. The apparatus of claim 1, wherein said antenna arrays are arranged around an axis that is oriented vertically with respect to the ground.

4. The apparatus of claim 1, wherein each of said antenna elements comprises a dipole antenna.

5. The apparatus of claim 1, wherein said network is configured to operate bidirectionally.

6. An apparatus, comprising:

a first duplexer and a second duplexer, each of said first and second duplexers having a common port, a first filter port and a second filter port, one of said first and second filter ports being a high-pass filter port and the other of said first and second filter ports being a low-pass filter port; and a power divider having a common port and a plurality of attenuated ports, wherein:

the first filter port of said first duplexer is connected to the first filter port of said second duplexer;

the second filter port of said first duplexer is connected to the common port of said power divider; and the second filter port of said second duplexer is connected to at least one of said plurality of attenuated ports of said power divider.

7. The apparatus of claim 6, further comprising a first antenna array connected to a common port of said second duplexer, and a second antenna array connected to a second attenuated port of said divider.

8. The apparatus of claim 7, wherein each of said antenna elements comprises a dipole antenna.

9. The apparatus of claim 6, further comprising a first antenna array connected to a common port of said second duplexer, a second antenna array connected to a second attenuated port of said power divider, and a third antenna array connected to a third attenuated port of said power divider, wherein said first, second and third antenna arrays are each located on a different side of a polygonal antenna body such that each array faces a different direction.

10. The apparatus of claim 9, wherein said polygonal antenna body has a triangular cross-section, and said plurality of antenna arrays consists of three antenna arrays, each having a neighboring antenna array on each of two neighboring faces, and each of said antenna arrays being arranged to direct radio-frequency energy at an angle of about 120° with respect to each of its neighboring antenna arrays.

11. A method, comprising:

providing a plurality of antenna arrays, each array of said plurality of antenna arrays comprising one or more antenna elements, each array of said plurality of antenna arrays being located on a separate side of a polygonal antenna body having three or more sides such that each array faces in a different direction;

connecting a radio-frequency (RF) network to said plurality of antenna arrays, said radio-frequency (RF) network comprising:

a first duplexer for splitting a received multifrequency drive signal having two frequency components into a first component having a first frequency and a second component having a second frequency;

a divider for splitting said first component into three or more attenuated portions, and for directing one of said three or more attenuated portions to a first array of said plurality of antenna arrays; and a second duplexer for combining another of said three or more attenuated portions with said second component to form a combined drive signal component, and for directing said combined drive signal component to a second array of said plurality of antenna arrays.

12. The method of claim 11, wherein each of said plurality of antenna arrays is located at one of three faces of said polygonal antenna body, each array having a neighboring antenna array on each of two neighboring faces, and each of said antenna arrays being arranged to direct radio-frequency energy at an angle of about 120° with respect to each of its neighboring antenna arrays.

13. The method of claim 11, wherein said antenna arrays are arranged around an axis that is oriented vertically with respect to the ground.

14. The method of claim 11, wherein each of said antenna elements comprises a dipole antenna.

15. The method of claim 11, wherein said network is configured to operate bidirectionally.

16. A method, comprising:

providing a first duplexer and a second duplexer, each of said first and second duplexers, having a common port, a first filter port and a second filter port, one of said first and second filter ports being a high-pass filter port and the other of said first and second filter ports being a low-pass filter port;

providing a power divider having a common port and a plurality of attenuated ports;

coupling the first filter port of said first duplexer to the first filter port of said second duplexer;

coupling the second filter port of said first duplexer to the common port of said power divider; and coupling the second filter port of said second duplexer to at least one of said plurality of attenuated ports of said power divider.

17. The method of claim 16, further comprising coupling a first antenna array to a common port of said second duplexer, and a second antenna array to a second attenuated port of said divider.

18. The method of claim 17, wherein each of said antenna elements comprises a dipole antenna.

19. The method of claim 16, further comprising coupling a first antenna array to a common port of said second duplexer, coupling a second antenna array to a second attenuated port of said power divider, and coupling a third antenna array to a third attenuated port of said power divider, wherein said first, second and third antenna arrays are each located on a different side of a polygonal antenna body such that each array faces a different direction.

20. The method of claim 19, wherein said polygonal antenna body has a triangular cross-section, and said plurality of antenna arrays consists of three antenna arrays, each having a neighboring antenna array on each of two neighboring faces, and each of said antenna arrays being arranged to direct radio-frequency energy at an angle of about 120° with respect to each of its neighboring antenna arrays.

* * * * *